US006359608B1

(12) United States Patent
Lebrun et al.

(10) Patent No.: US 6,359,608 B1
(45) **Date of Patent: *Mar. 19, 2002**

(54) METHOD AND APPARATUS FOR DRIVING FLAT SCREEN DISPLAYS USING PIXEL PRECHARGING

(75) Inventors: Hughes Lebrun, Coublevle; Francois Maurice, Tullins; Eric Sanson, Grenoble; Bruno Mourey, Volron, all of (FR)

(73) Assignee: Thomson LCD, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/913,703

(22) PCT Filed: Jan. 9, 1997

(86) PCT No.: PCT/FR97/00039

§ 371 Date: Sep. 8, 1997

§ 102(e) Date: Sep. 8, 1997

(87) PCT Pub. No.: WO97/25706

PCT Pub. Date: Jul. 17, 1997

(30) Foreign Application Priority Data

Jan. 11, 1996 (FR) ..... 96 00259

(51) Int. Cl.[7] ..... G09G 3/36

(52) U.S. Cl. ..... 345/100; 345/98

(58) Field of Search ..... 345/94, 208, 206, 345/204, 90, 92, 100, 103, 98, 215, 58, 89

(56) References Cited

U.S. PATENT DOCUMENTS

| | | | | | |
|---|---|---|---|---|---|
| 5,426,447 | A | * | 6/1995 | Lee | 345/103 |
| 5,686,936 | A | * | 11/1997 | Maekawa et al. | 345/100 |
| 5,708,454 | A | * | 1/1998 | Katoh et al. | 345/100 |
| 5,892,493 | A | * | 4/1999 | Enami et al. | 345/94 |
| 5,940,057 | A | * | 8/1999 | Lien et al. | 345/89 |

FOREIGN PATENT DOCUMENTS

| | | |
|---|---|---|
| EP | 0 678 849 A1 | 10/1995 |
| EP | 0 737 957 A1 | 10/1996 |
| WO | WO 94/16428 A1 | 7/1994 |

* cited by examiner

*Primary Examiner*—Richard Hjerpe
*Assistant Examiner*—Francis Nguyen
(74) *Attorney, Agent, or Firm*—Joseph S. Tripoli; Harvey D. Fried; Sammy S. Henig

(57) ABSTRACT

The present invention relates to a method for addressing a flat screen composed of lines and columns, with pixels located at their intersections, characterized in that, at the start of each sampling of the video signal to be displayed on the screen, a voltage (Vr) higher than the working voltage range (V) is applied to the selected pixel for a time tr, then the working voltage is sampled for a time ts.

8 Claims, 6 Drawing Sheets

METHOD AND APPARATUS FOR DRIVING FLAT SCREEN DISPLAYS USING PIXEL PRECHARGING

FIELD OF THE INVENTION

The present invention relates to a method for addressing a flat screen, more particularly a liquid-crystal display screen, using pixel precharging. The present invention also relates to a column driver of such a screen, for implementing the method, as well as the application of the method to large screens.

BACKGROUND OF THE INVENTION

Direct-view or projection liquid-crystal display screens are generally composed of lines (selection lines) and columns (data lines), with the pixel electrodes, connected through transistors to these lines, being located at their intersections. The gates of these transistors form the selection lines and are driven by the peripheral drivers which scan the lines and turn on the transistors of each line, to make it possible, by means of the data lines connected to the other peripheral drivers, to charge the pixel electrodes and modify the optical properties of the liquid crystal contained between these electrodes and the backing electrode (or reference electrode), thus making it possible to form images on the screen.

FIG. 1 represents the equivalent circuit diagram of a flat-screen pixel addressed by the line and column drivers. The electrode and the backing electrode enclosing the liquid crystal form a capacitor 1 whose charge (most often consisting of video data) is transmitted by the column 2 through the transistor 3 driven by the selection line 4. For its part, FIG. 2 represents the time profiles of the operation of this pixel, Vs being the signal addressed by the selection line of a row of pixels, Vc being the video signal sampled from the selected row of pixels and Vp being the effective charge of one of these pixels. In theory, at the end of a sampling pulse, the pixel voltage Vp across the terminals of the liquid crystal should be equal to the column voltage Vc, that is to say +/−V.

The problem with this type of addressing is that, in practice, the voltage Vp is different from the charging voltage Vc of the column. This is because, when it is on, each transistor 3 has a non-zero resistance Ron, so that the charge of the pixel exhibits an exponential characteristic (as represented in FIG. 2) whose time constant is non-zero since it is equal to the product Ron×C, C being the capacitance of the pixel capacitor 1. When the charging time has elapsed, the residual convergence error is equal to Ven+ in positive frame (negative value) or Ven− in negative frame (positive value), which are different from the values +/−V of the charging voltage Vc.

This results in an error on the RMS voltage tilting the liquid crystal of the order of (Ven+−Ven)/2. However, the electro-optical specifications of a screen set a maximum value for this error, of the order of 5 to 10 mV for a 90° twisted nematic effect. The product RC (resistance times capacitance) must therefore typically be 7 to 8 times less than the addressing time in order to achieve a convergence rate which is compatible with a high-quality application. This entails limitations on the number of lines which can be addressed as well as on the size of the pixels. In this case, R needs to be reduced, that is to say the transistor needs to be widened. This is not realistic beyond a channel width-to-length ratio of more than a few units. Furthermore, when the pulse Vs applied to the selection line returns to the low state (see FIG. 2), the parasitic coupling between the line and the pixel becomes excessive when the transistor width exceeds a certain value.

Another known solution is represented in FIG. 3. In this case, a screen 5 consisting of pixels 6 is addressed by a line driver 7 and a column driver 8 which is formed by samplers driven by a shift register. The load of a sampler is none other than the distributed capacitance of the driven column 9. This column needs to be charged over a very short time, with the above-mentioned conversion problems aggravated by the fact that the charging time is no more than a fraction of the time when a line 9 is addressed. This is because, during this line time, the video needs to be sampled successively over all the columns of the screen. For this reason, the production of integrated-driver screens has to date required the use of a high-mobility semiconductor, for example monocrystalline or polycrystalline silicon.

In order to overcome the above drawbacks, and to allow the use of thin-film transistors produced in silicon, it has been proposed, in particular in application PCT/FR94/16428, to precharge the pixels to a voltage lower than the working voltage. There are a number of drawbacks with using a voltage of this type. In particular, it does not solve the convergence problem.

SUMMARY OF THE INVENTION

The present invention provides a novel addressing method for overcoming the drawbacks mentioned above.

The present invention accordingly relates to a method for addressing a flat screen composed of lines and columns, with pixels located at their intersections, characterized in that, at the start of each sampling of the video signal to be displayed on the screen, a voltage (Vr) higher than the working voltage range (V) is applied to the selected pixel for a time tr, then the working voltage is sampled for a time ts.

Preferably, the precharge voltage (Vr) is chosen such that Ven+=Ven− where Ven+ and Ven− represent the residual error respectively in positive frame and in negative frame. In this case, the precharge voltage is obtained by the following formula:

$$Ven+=(Vr-V+)\exp-\frac{ts}{\tau(Vg-Vt-V+)} \text{ and}$$

$$Ven-=(Vr-V-)\exp-\frac{ts}{\tau(Vg-Vt-V-)}$$

Where Vg is the gate voltage of the transistor during the sampling and Vt is its threshold voltage.

The condition Ven+=Ven− is written:

$$(Vr-Vt)=(Vr-V-)\exp-ts\left(\frac{1}{\tau(Vg-Vt-V-)}-\frac{1}{\tau(Vg-Vt-V+)}\right)$$

or τ(Vg−Vt−V−)=Ron(Vg−Vt−V−)×C and $$Ron=\frac{1}{\mu Cox\frac{W}{L}(Vg-Vt-V-)}$$

whence τ(V) is of the form $$\frac{Cte}{V}$$

whence $$(Vr - V+) = (Vr - V-)\exp - \frac{ts}{\tau(V+ - V-)}$$

i.e.

$$Vr = V + (V+ - V-)\frac{\exp - \frac{ts}{\tau(V+ - V-)}}{1 - \exp - \frac{ts}{\tau(V+ - V-)}}$$

The present invention also relates to a column driver of a flat screen of the type comprising samplers driven by the outputs of the shift register, characterized in that each sampler consists of three Metal-Insulator-Semiconductor (MIS)-type transistors mounted in parallel so that their first electrode is connected to the video signal and their second electrode is connected to the driven column, the gate of the first transistor being connected to one of the outputs of the shift register and the gates of the second and third transistors being connected to two clocks chosen so that one of the two transistors is activated to precharge the even frames and the other is activated to precharge the odd frames.

According to another characteristic of the invention, the clock voltage applied to the second and third transistors is chosen so that, when a transistor is not being used for the precharging, its gate receives a negative voltage allowing subsequent compensation for the capacitive coupling when this voltage returns to zero.

Preferably, the three transistors are identical and are thin-film transistors, TFTs. This solution makes it possible to compensate for the strong capacitive coupling, because the transistors used to produce the samplers are large. It furthermore makes it possible to distribute the stress or fatigue evenly over the three transistors, which have the same size, this having the effect of increasing the life of the transistors.

The present invention also relates to the application of the above addressing method to large screens.

The present invention therefore relates to a method for addressing a flat screen including lines and columns, with pixels located at their intersections, in which X line drivers are each connected to Y lines, characterized in that, for a time tr, the pixels located on the lines connected to the first line driver are precharged to a voltage (Vr) higher than the working voltage range (V), then the Y lines are sampled successively and the above operation is repeated for the X-1 remaining drivers The present invention also relates to a method for addressing a flat screen including lines and columns, with pixels located at their intersections, in which X line drivers are each connected to Y lines, characterized in that the first line of each of the X line drivers is simultaneously precharged to a voltage Vr higher than the working voltage range (V) and the said line of the X line drivers is then sampled successively and the above operation is repeated for the Y-1 other lines of each of the X line drivers.

BRIEF DESCRIPTION OF DRAWINGS

The present invention will be understood more clearly, and additional advantages will emerge, on reading the following description which is illustrated by the following figures.

DETAILED DESCRIPTION OF THE INVENTION

Figure 4:
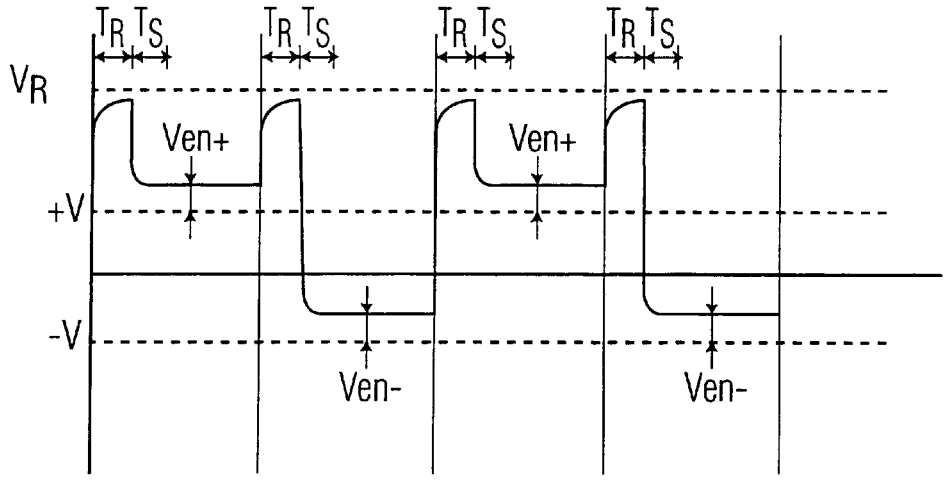
FIG. 4 illustrates a method of addressing a liquid-crystal display screen according to the present invention.

As represented in FIG. 4, over a reset time tr, a voltage Vr higher than the working voltage is sampled from the load, and the working voltage (between +V and −V) is sampled over a time ts. Since the intention is to reach the working voltage (between +V and −V) from a higher voltage value, the residual convergence error is always of the same sign and equal to (Ven+−Ven−)/2, which minimizes the error on the RMS voltage.

When the pixel transistors are made from amorphous silicon (a—Si) and have a threshold voltage of a few volts, there is a precharging voltage Vr such that the convergence errors Ven+ and Ven− for reaching the two extrema of the working voltage range (+V, −V) are equal (Ven+=−Ven−). The error on the RMS voltage is then zero. This voltage Vr can be obtained by using the following formula:

$$Ven+ = (Vr - V+)\exp - \frac{ts}{\tau(Vg - Vt - V+)} \text{ and}$$

$$Ven- = (Vr - V-)\exp - \frac{ts}{\tau(Vg - Vt - V-)}$$

where Vg is the gate voltage of the transistor during the sampling and Vt is its threshold voltage.

The condition Ven+=Ven− is written:

$$(Vr - Vt) = (Vr - V-)\exp - ts\left(\frac{1}{\tau(Vg - Vt - V-)} - \frac{1}{\tau(Vg - Vt - V+)}\right)\Bigg) \text{ or}$$

$$\tau(Vg - Vt - V-) = Ron(Vg - Vt - V-) \times C$$

and $$Ron = \frac{1}{\mu Cox \frac{W}{L}(Vg - Vt - V-)}$$

whence τ(V) is of the form $$\frac{Cte}{V}$$

whence $$(Vr - V+) = (Vr - V-)\exp - \frac{ts}{\tau(V+ - V-)}$$

i.e.

$$Vr = V + (V+ - V-)\frac{\exp - \frac{ts}{\tau(V+ - V-)}}{1 - \exp - \frac{ts}{\tau(V+ - V-)}}$$

Figure 5:
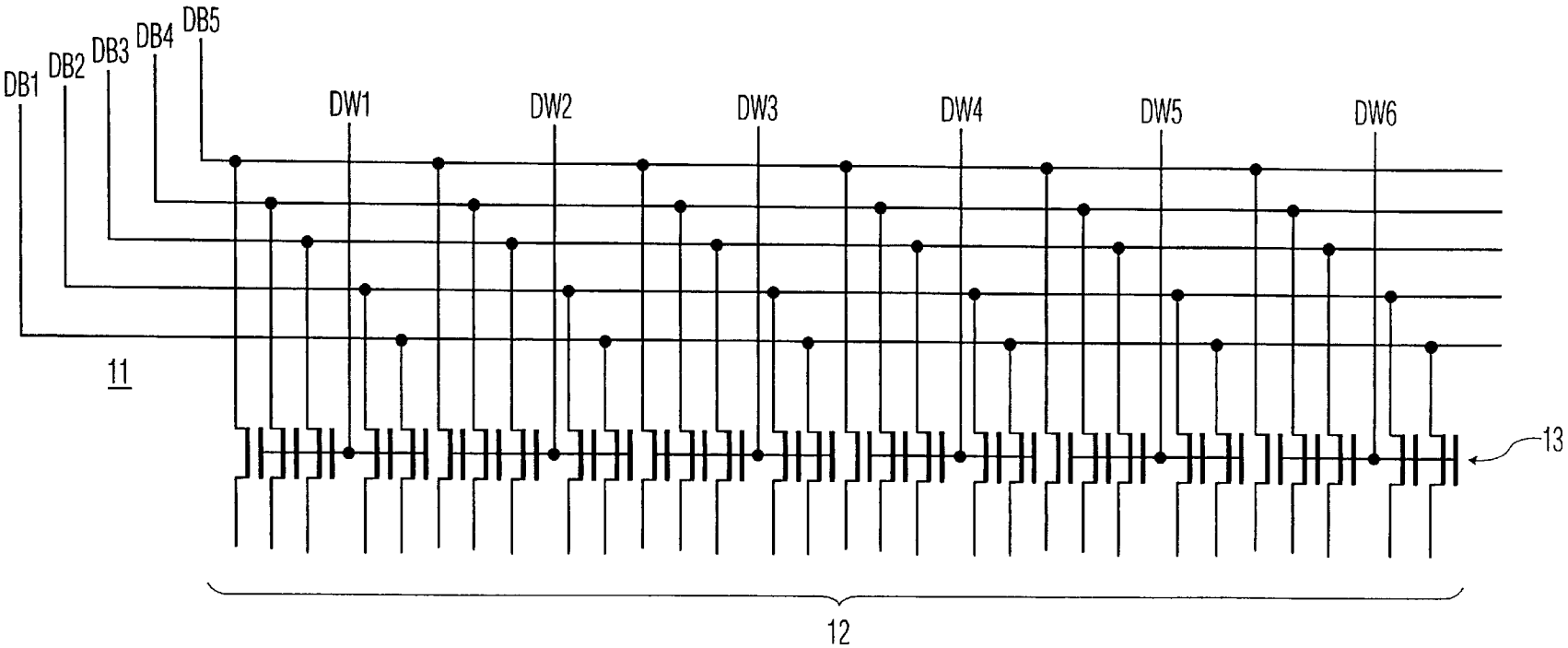
FIG. 5 represents one embodiment of a known column driver employing the addressing method according to the present invention.

FIG. 5 represents an illustrative embodiment of a column driver of a screen allowing implementation of the method according to the invention. This driver is formed by transistors produced from amorphous silicon. This driver 11 preferably consists of a plurality of video inputs operating in parallel to commensurately reduce the multiplexing frequency. In the intentionally simplified example in FIG. 5, the column driver has five video inputs DB1 to DB5 and six demultiplexing-signal inputs DW1 to DW6, which allows thirty columns 12 to be charged. Each column 12 is driven by a single transistor 13 which is successively used for precharging to reach the voltage Vr over a time tr, and for convergence to the appropriate video voltage value.

Figure 6:
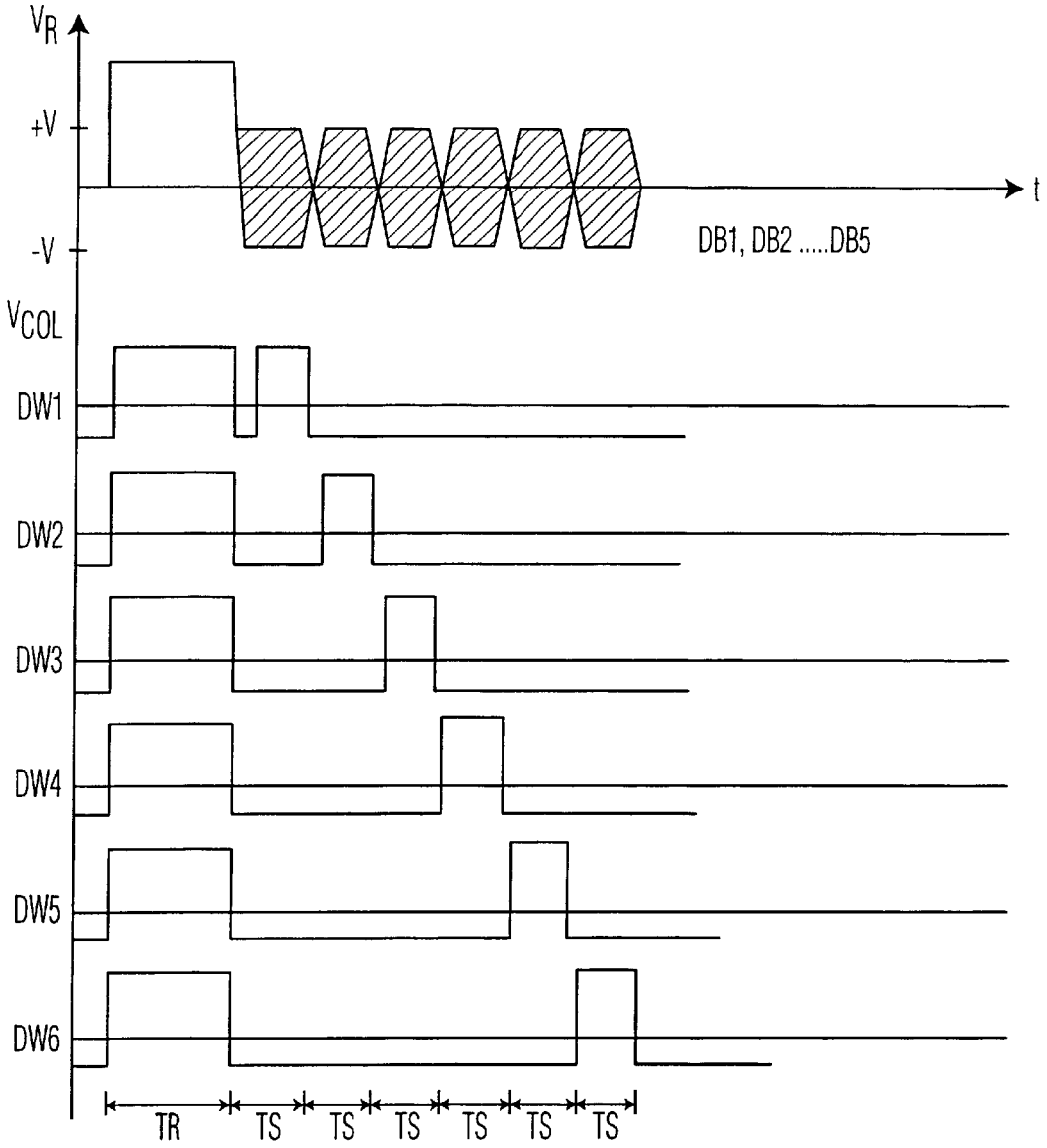
FIG. 6 represents the time diagram of a column driver according to FIG. 5.

FIG. 6 represents the time diagram of the operation of the screen in FIG. 5 when it is being used according to the method of the invention. Over a time tr, a voltage Vr higher than the working voltage is applied to all the columns via the signals DW1 to DW6. The inputs DW1 to DW6 are then selected successively, as represented by DW1 to DW6, for each signal DB1 to DB5, the working voltage being sampled over a time ts.

Figure 7:
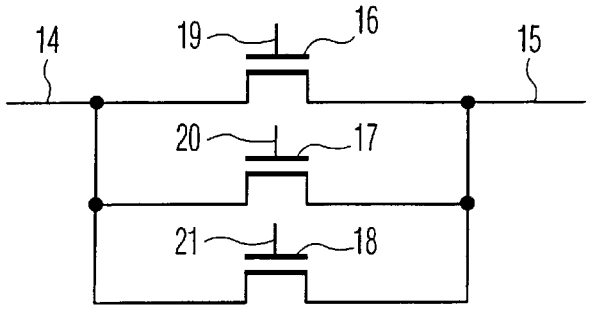
FIG. 7 represents a preferred embodiment of a column driver employing the method according to the present invention.

FIG. 7 represents a preferred embodiment of a column driver employing the present invention. In this case, each sampler consists of three transistors 16, 17 and 18 which are preferably identical and mounted in parallel. As FIG. 7 clearly represents, the first electrodes, or drains, of the three transistors 16, 17 and 18 receive the input video signal 14, whereas their second electrode, or source, charges the column 15 to be driven. Furthermore, the gate of the transistor 16 is connected to the output of a shift register and receives a demultiplexing signal 19, whereas the gates 20 and 21 of the other two transistors 17 and 18 are connected to two clocks which will be described in more detail below. The use of the three transistors makes it possible to compensate for the strong capacitive coupling with a single large transistor and to distribute the stress over the transistors, which increases their life.

Figure 8:
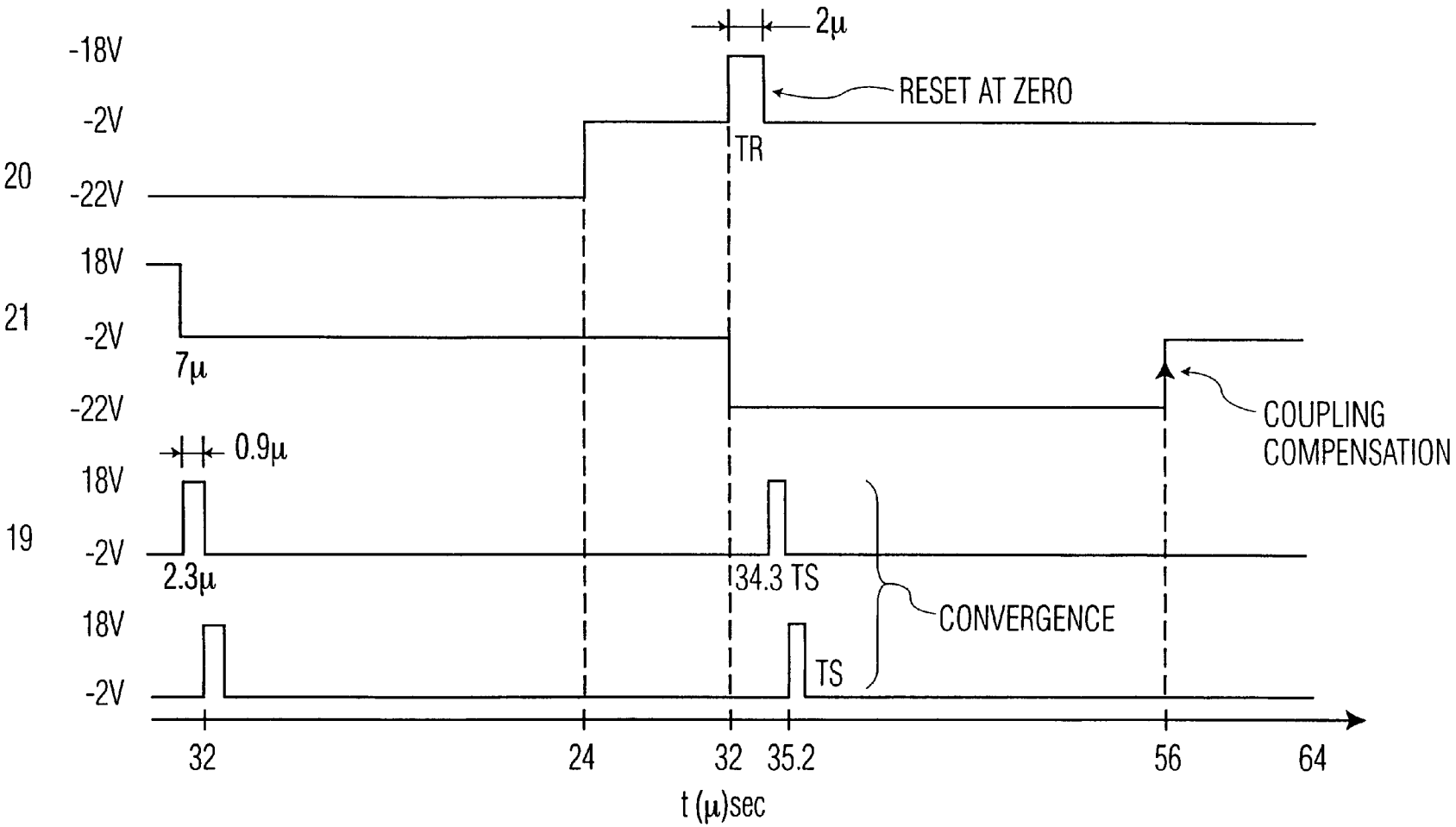
FIG. 8 represents the time diagram of the operation of the column driver in FIG. 7, and FIG. 9 schematically represents a part of a large flat screen connected to line and column drivers using the method of the present invention.

FIG. 8 represents the time diagram of a line driver of the type in FIG. 7. The numerical values are given here solely as an example. The clock signals applied to the transistors 17 and 18 are such that one of the transistors precharges the odd lines while the other precharges the even lines. Furthermore, when the gate 20 of one of the transistors, for example transistor 17, receives a precharging pulse over a time tr, the gate 21 of the other transistor 18 receives a negative pulse of, for example, −22V until the end of the line time, so as to make it possible to compensate for the coupling of the convergence transistor at the end of the line time by virtue of a positive pulse on the control electrode 21. The gate of the transistor 16 will receive a pulse of duration ts so as to produce convergence. The precharging takes approximately twice as long (2 μs) as the convergence (0.9 μs), so that the duty ratio of the operation of the three transistors is equivalent, which distributes the stress evenly.

Figure 1:
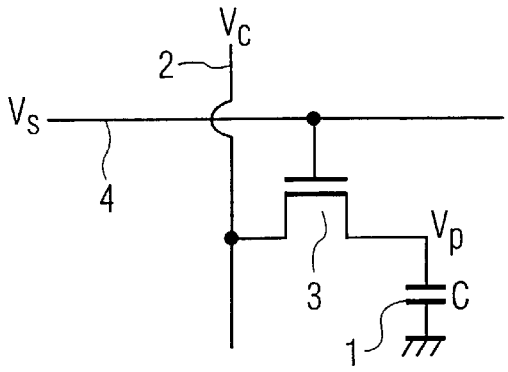
FIG. 1 PRIOR ART
FIG. 1, already described, represents the equivalent circuit diagram of a pixel of a liquid-crystal display screen, FIG. 2, already described, represents the time diagrams of the operation of the pixel in FIG. 1, FIG. 3, already described, represents a known structure of a screen driven by line and column drivers.
Figure 2:
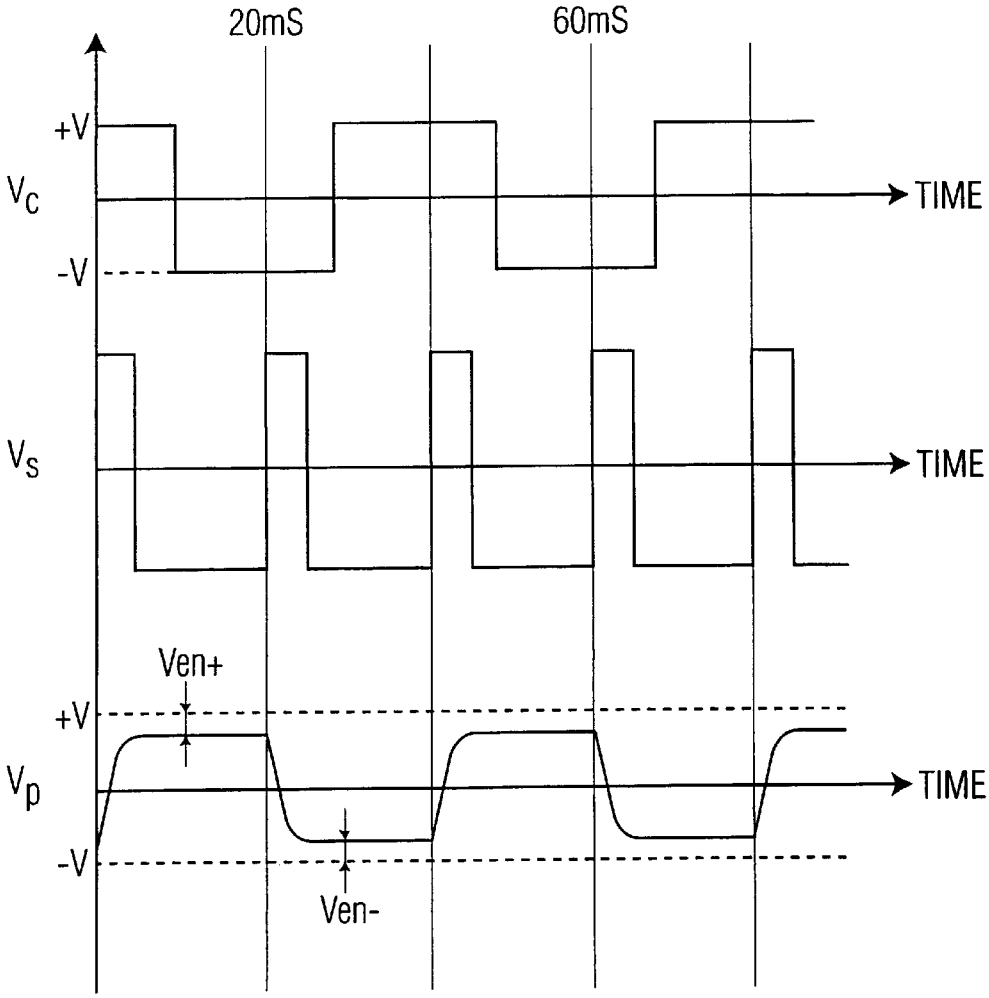
FIG. 2 PRIOR ART
Figure 3:
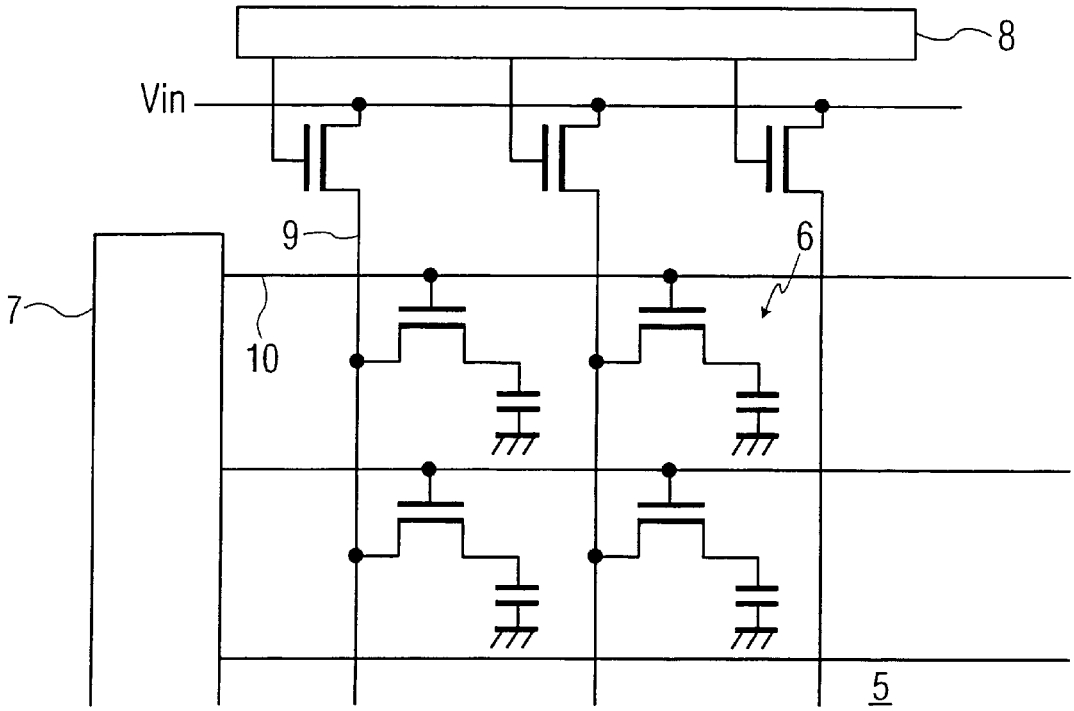
FIG. 3 PRIOR ART

In the case of a screen having a very large number of lines or having a very large number of elementary pixels, the transistor is underdesigned to prevent having excessively strong coupling capacitances. The basic diagram may be of the type in FIG. 1. To improve the operation of such a screen in which either the transistor is too small for correct charging of the pixel conventionally, or the number of lines is so high that only very little time is available for charging, it is also possible to use an operating diagram with precharging of the type in FIG. 4.

Figure 9:
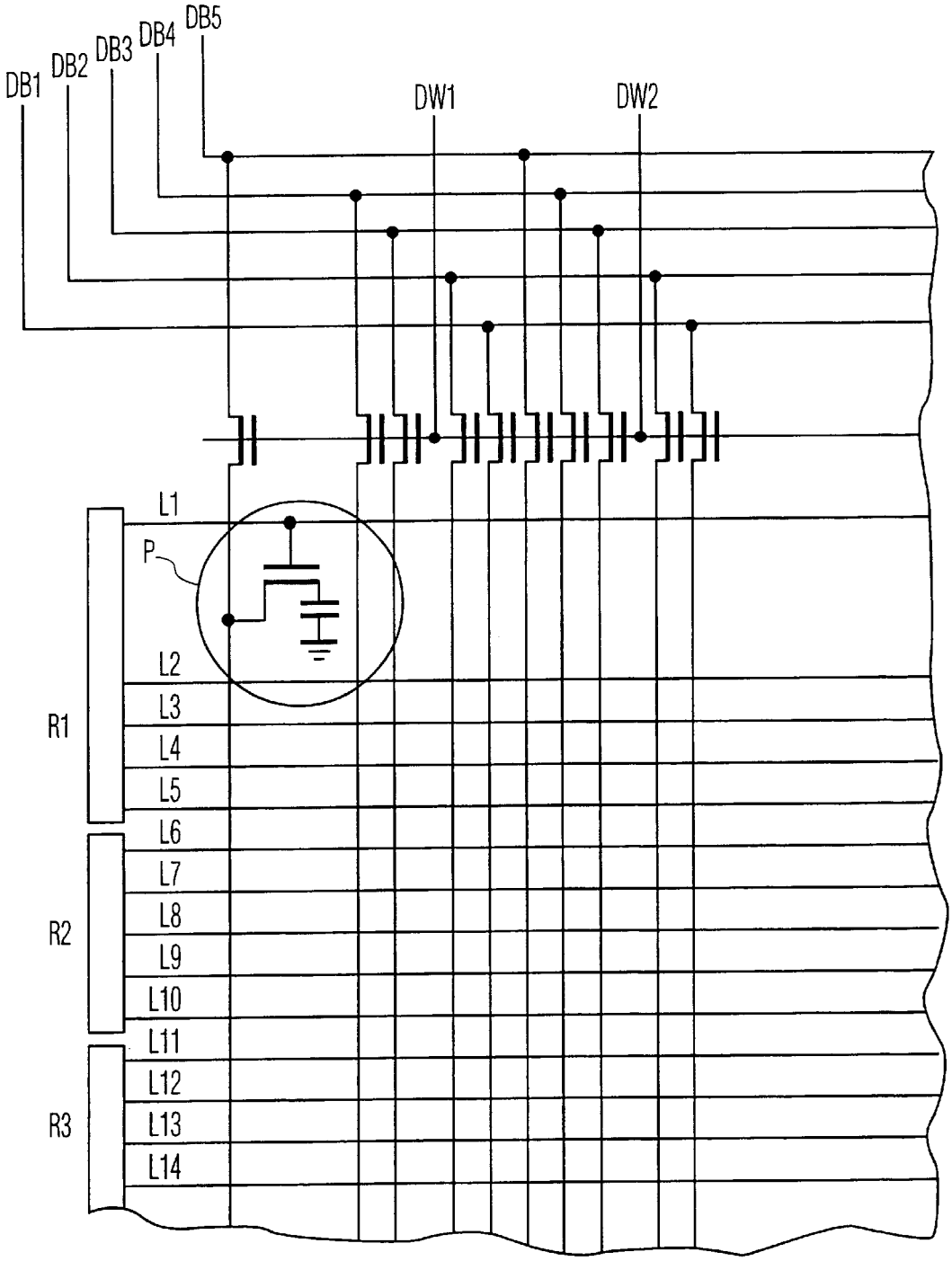

In this case, operation is preferably carried out by line packets. Thus, as represented in FIG. 9, which relates to a screen whose column driver is identical to the driver in FIG. 5, and in which the lines are grouped in fives, each group being driven by a line register R1, R2, R3 . . . for the five-line packets, the lines L1 to L5 are firstly precharged simultaneously, then the same lines L1 to L5 are sampled sequentially. The lines L6 to L10 are then precharged simultaneously, and so on. This mode of operation is incompatible with customary drivers (driving five lines at once). It therefore needs specific electronics.

If, for example, the screen uses five line drivers such as R1, R2, R3, . . . , for six hundred lines, it is also possible to charge the five drivers simultaneously, and the often present output-enable function is used to successively manage the simultaneous precharging for five lines, for example the first five lines L1, L6, L11 in the embodiment in FIG. 9, driven by these five circuits R1, R2, . . . , then the successive addressing of these five lines. However, a solution of this type requires a frame memory for storing and therefore reconstructing the video image.

In any case, the precharging is carried out by using a voltage Vr higher than the working voltage V+/V−.

The present invention applies in particular to flat liquid-crystal display screens driven by an active matrix of thin-film transistors (AMLCDs), and in general to any application which needs a sampler whose relative precision is greater than its absolute precision.

What is claimed is:

1. A method for addressing a screen composed of lines and columns with pixels located at intersections of the lines and columns, wherein, at the start of each sampling of a video signal to be displayed on the screen, a precharge voltage higher than a maximum voltage value associated with a working voltage is applied to a selected pixel for a time tr, and then the working voltage is sampled for a time ts, wherein said working voltage has a range between said maximum voltage value and a minimum voltage value and wherein said maximum and minimum voltage values correspond to respective maximum and minimum voltage values associated with said video signal to be displayed, and wherein the precharge voltage is obtained by the following formula:

$$Ven+ = (Vr - V+)\exp - \frac{ts}{\tau(Vg - Vt - V+)} \text{ and}$$

$$Ven- = (Vr - V-)\exp - \frac{ts}{\tau(Vg - Vt - V-)}$$

where Vg is the gate voltage of the transistor during the sampling and Vt is its threshold voltage, and wherein the condition Ven+=Ven− is written:

$$(Vr-Vt)=(Vr-V-)\exp-ts\left(\frac{1}{\tau(Vg-Vt-V-)}-\frac{1}{\tau(Vg-Vt-V+)}\right)$$

or τ(Vg−Vt−V−)=Ron(Vg−Vt−V−)×C
and Ron $$Ron=\frac{1}{\mu Cox\frac{W}{L}(Vg-Vt-V-)}$$

whenceτ(V)is of the form $$\frac{CTe}{V}$$

and represents a time constant associated with the capacitance of a pixel, and where $\mu$ is the permittivity, whence $$(Vr-V+)=(Vr-V-)\exp-\frac{ts}{\tau(V+-V-)}$$

such that $$Vr=V+(Vr+-V-)\frac{\exp-\frac{ts}{\tau(V+-V-)}}{1-\exp-\frac{ts}{\tau(V+-V-)}}$$

wherein V+ and V− represent limits of the working voltage range and W and L are respectively the width and length of the transistor pixel channel.

2. Column driver for a screen, comprising samplers driven by outputs of a shift register, wherein each sampler is comprised of three Metal-Insulator-Semiconductor (MIS) type transistors mounted in parallel so that their first electrode is connected to receive a video signal and their second electrode is connected to a driven column, a gate of the first transistor being connected to one of the outputs of the shift register and gates of the second and third transistors being connected to two clocks chosen so that one of the second and third transistors is activated to precharge even frames and the other is activated to precharge odd frames.

3. Driver according to claim 2, wherein the clock voltage applied to the second and third transistors is chosen so that, when a transistor is not being used for the precharging, its gate receives a negative voltage allowing compensation for capacitive coupling when the gate voltage subsequently rises again.

4. Driver according to claim 3, wherein the three transistors are identical.

5. Driver according to claim 4, wherein the three transistors are produced using thin-film technology.

6. Method for addressing a screen composed of lines and columns, with pixels located at intersections of the lines and columns, wherein, at the start of each sampling of a video signal to be displayed on the screen, a precharge voltage higher than a maximum voltage value associated with a working voltage is applied to a selected pixel for a time tr, and then the working voltage is sampled for a time ts, wherein said working voltage has a range between said maximum voltage value associated with a positive frame and a minimum voltage value associated with a negative frame, and wherein the precharge voltage is chosen such that Ven+=Ven− where Ven+ and Ven− represent the residual error respectively in positive frame and in negative frame.

7. Method for addressing a screen composed of lines and columns, with pixels located at intersections of the lines and columns, wherein, at the start of each sampling of a video signal to be displayed on the screen, a precharge voltage (Vr) higher than a working voltage (V) is applied to a selected pixel for a time tr, and then the working voltage is sampled for a time ts, and wherein the precharge voltage is obtained by the following formula:

$$Ven+=(Vr-V+)\exp-\frac{ts}{\tau(Vg-Vt-V+)}\text{ and}$$

$$Ven-=(Vr-V-)\exp-\frac{ts}{\tau(Vg-Vt-V-)}$$

where Vg is the gate voltage of the transistor during the sampling and Vt is its threshold voltage, and wherein the condition Ven+=Ven− is written:

$$(Vr-Vt)=(Vr-V-)\exp-ts\frac{1}{\tau(Vg-Vt-V-)}-\frac{1}{\tau(Vg-Vt-V+)}\Big)\text{ or}$$

$$\tau(Vg-Vt-V-)=Ron(Vg-Vt-V-)\times C$$

or τ(Vg−Vt−V−)=Ron(Vg−Vt−V−)×C
and $$Ron=\frac{1}{\mu Cox\frac{W}{L}(Vg-Vt-V-)}$$

whence τ(V) is of the form $$\frac{CTe}{V}$$

and represents a time constant associated with the capacitance of a pixel, and where $\mu$ is the permittivity, whence $$(Vr-V+)=(Vr-V-)\exp-\frac{ts}{\tau(V+-V-)}$$

such that $$Vr=V+(Vr+-V-)\frac{\exp-\frac{ts}{\tau(V+-V-)}}{1-\exp-\frac{ts}{\tau(V+-V-)}}$$

wherein V+ and V− represent limits of the working voltage range and W and L are respectively the width and length of the transistor pixel channel.

8. Method for addressing a screen composed of lines and columns with pixels located at intersections of the lines and column, wherein, at the start of each sampling of a video signal to be displayed on the screen, a precharge voltage, Vr, higher than a maximum voltage value associated with a working voltage V is applied to a selected pixel for a time tr, and then the working voltage is sampled for a time ts, wherein said working voltage has a range between said maximum voltage and a minimum voltage value and said precharge voltage is obtained by the following formula:

$$Vr = V + (V + - V -)\frac{\exp - \frac{ts}{\tau(V + - V -)}}{1 - \exp - \frac{ts}{\tau(V + - V -)}}$$

wherein V+ and V− represent limits of said working voltage range, and wherein τ (V+−V−) represents a time constant associated with the capacitance of a pixel.

* * * * *